US007955415B2

(12) United States Patent
Farone

(10) Patent No.: US 7,955,415 B2
(45) Date of Patent: Jun. 7, 2011

(54) NATURAL GAS STORAGE APPARATUS AND METHOD OF USE

(75) Inventor: William A Farone, Irvine, CA (US)

(73) Assignee: Vista Texas Holdings, LLC, Houston, TX (US)

( * ) Notice: Subject to any disclaimer, the term of this patent is extended or adjusted under 35 U.S.C. 154(b) by 84 days.

(21) Appl. No.: 12/134,290

(22) Filed: Jun. 6, 2008

(65) Prior Publication Data

US 2009/0283427 A1 Nov. 19, 2009

Related U.S. Application Data

(60) Provisional application No. 60/942,239, filed on Jun. 6, 2007.

(51) Int. Cl.
*F17C 11/00* (2006.01)

(52) U.S. Cl. ..... 95/1; 96/414; 206/0.7

(58) Field of Classification Search ..... 95/14, 90, 95/143, 1, 901, 902; 96/109, 146, 414; 206/0.7; 73/28.01

See application file for complete search history.

(56) References Cited

U.S. PATENT DOCUMENTS

| | | | | |
|---|---|---|---|---|
| 2,663,626 | A * | 12/1953 | Spangler | 48/190 |
| 5,460,745 | A * | 10/1995 | Lee | 252/182.32 |
| 5,626,637 | A * | 5/1997 | Baker | 48/127.3 |
| 5,912,424 | A * | 6/1999 | Judkins et al. | 95/143 |
| 6,692,554 | B1 * | 2/2004 | Leffel et al. | 96/108 |
| 7,060,653 | B2 * | 6/2006 | Nakamura | 502/416 |
| 7,309,380 | B2 * | 12/2007 | Muller et al. | 95/141 |
| 2002/0023539 | A1 * | 2/2002 | Tange et al. | 95/143 |
| 2009/0229555 | A1 * | 9/2009 | Ginzburg et al. | 123/1 A |

FOREIGN PATENT DOCUMENTS

JP 11-030154 A * 2/1999

* cited by examiner

*Primary Examiner* — Frank M Lawrence
(74) *Attorney, Agent, or Firm* — C. H. O'Donohue

(57) ABSTRACT

There is described a storage system and associated methods having increased storage capacity for natural gas or methane. The systems and methods store a larger quantity of natural gas at similar pressures and volumes to conventional storage systems. The systems utilize readily available carbons treated to increase the amount of natural gas adsorbed to the carbon to store a high level of natural gas.

7 Claims, 1 Drawing Sheet

1 Gas Compressor
2 Attachment and Check Valve
3 Gas Storage Tank with Heating
4 Temperature Sensor
5 Pressure Sensor
6 Supported Membrane Filter
7 Light Source (e.g. LED)
8 Light Detector
9 Light Activated Controller
10 Powered Solenoid Valve (NC)
11 Pressure Sensor
12 Reducing Regulator
13 Programmable Controller
14 Powered Solenoid Valve (NC)
15 Pressure Sensor
16 Flow Sensor

NATURAL GAS STORAGE APPARATUS AND METHOD OF USE

This application claims the benefit of U.S. Provisional Application No. 60/942,239, filed Jun. 6, 2007.

FIELD

The present disclosure relates to systems and associated methods having increased storage capacity for natural gas or methane. In particular, systems and methods utilizing carbon treated to increase the amount of natural gas adsorbed to the carbon is disclosed. Thus, the systems and methods store a larger quantity of natural gas at similar pressures and volumes to conventional storage systems. Further the production, shipping and utilization of the material in actual storage tanks is described.

BACKGROUND

Activated carbon has the property of adsorbing hydrocarbon rich gas, including methane or natural gas and allowing one to store more of the gas in a tank of a given volume than the tank would hold in the absence of carbon. However, there are problems involved in the handling of carbon preventing successful commercial utilization of the process. For example, carbon in the form of a fine powder or particles which may catch fire when exposed to air and possible dust explosions present a serious hazard. Also carbon in the form of a fine powder or particles presents serious respiratory toxic risks upon inhalation. Additionally, these forms of carbon have a tendency to be embedded and travel with the gas when it is released. Carbon particles are known to clog valves and equipment and are detrimental to equipment with moving parts. In the past there is art wherein the carbons are formed into structured systems which are placed into storage tanks. This potential solution increases the cost of the carbon and the cost of the tank into which it is placed.

Various methods have been utilized to store and/or to increase the storage capacity of tanks utilized for the storage of natural gas. U.S. Pat. No. 5,548,258 discloses the use of hydroxy phenoxyether polymer barrier liner for use in a tank storing compressed natural gas (CNG). U.S. Pat. No. 5,603,360 describes the use of a flexible bladder for the transportation of gas from a pipeline to a CNG automobile re-fueling station. U.S. Pat. No. 5,676,180 further describes the use of this bladder as a storage means for CNG at the automobile re-fueling station or other end user locations. U.S. Pat. No. 6,217,626 discloses the use of selected additives which allows one to store the natural gas at pressures around 1000 psia. For storage or pipeline transportation of natural gas at pressures over 800 psia it was found advantageous to add ammonia to the natural gas. U.S. Pat. No. 6,613,126 discloses a method of separating natural gas into a high carbon component and a low carbon component and using two tanks with adsorbent that will adsorb either the high carbon or the low carbon fraction. They used activated carbon for the absorption of natural gas which required that normal paraffin be pre-absorbed on the activated carbon prior to the absorption of natural gas. This method requires the re-mixing of the components upon releasing from the storage tanks and prior to use. The natural gas can not go into the end use apparatus without this mixing step prior to utilization.

U.S. Pat. No. 4,999,330 discloses a process wherein bulk carbon is reduced in bulk from about 50% to 200% which gives an increase in absorption capacity of about 50 to 200% in density. This process was found useful in low pressure storage of CNG. This process also calls for the use of a binder such as methyl cellulose.

Some activated carbons can increase the capacity of gas storage in a tank. The gas molecules are held on the surface of the carbon (science of surface chemistry) and thus the amount of gas that can be stored in a tank increases based on the available carbon surface area. The economics connected with such carbons makes them unattractive being sold at prices ranging from US$50 to US$125 per pound. These materials do not solve the problem at a financial cost that would allow the materials to be used in increased mass storage of natural gas. Additionally these materials do not allow for convenient filling and use of the methane or natural gas.

There was given in literature sources a carbon that appeared to have the necessary gas adsorption characteristics; i.e., the carbon could store twice or more the amount of natural gas in the same volume at the same pressure, e.g. ambient temperatures at 3,000 psia, in the same size tank. The carbon was identified as AX-21 and upon testing it was found capable of storing 2.6 times the amount of methane in the same tank as that tank without the presence of AX-21. This carbon is no longer manufactured and if available the price was given as $50 a pound by the manufacturer for purchases in large volume. The characteristics of this particular carbon are given in Table 1.

Table 1 lists the samples and the "surface area" of the carbon sample as measured by the adsorption of nitrogen in a specific test. The results for surface area are available for many adsorbents from commercial suppliers. However, nitrogen is not methane and, as the Table shows, it was found that the correlation between the nitrogen capacity and the methane capacity is very weak. Suitable carbons cannot be found simply by selecting low density, high surface area carbons.

A carbon surface contaminated by undesirable adsorbates has limited capacity for additional binding. Freshly prepared activated carbon typically has a clean surface. Activated carbon production with heating drives off potential adsorbates including water leading to a surface with high adsorptive capacity. While activated carbon has been used in some applications to remove selected hydrocarbons from water these applications teach away from the use in this particular application as water would interfere with the ability of the carbon to adsorb sufficient gas to enable one to store about twice the quantity of gas within a storage container. It is known that humidity is one of the factors that influence the adsorptive properties of active carbon in air.

Accordingly, a method, device and/or system of a carbon material stored, charged and discharged with gas having reduced risks of fire, explosion and ability to stored at least twice the volume of gas as normally stored is needed.

SUMMARY

The present disclosure describes a fuel storage system with increased storage capacity for natural gas or methane storage. The fuel storage system comprises a storage tank filled with activated carbon; a means of regulating temperature; flow regulators; and a particle detection system to detect carbon particle leaks. The regulation of temperature is based on the instantaneous pressure in the system and the flow rate at which the gas is removed is also described. This is necessary to maintain the necessary flow of gas for use in energy production such as automotive applications. In a further embodiment the fuel storage tank is filled with zeolites or with metal-organic frameworks.

There is further described a method of using this increased capacity of a tank for storing natural gas or methane comprising filling the tank with an activated carbon with selected adsorbent properties; attaching a filter system to remove presence of particles; providing means to remove stored gas from apparatus; and providing an optical sensor feedback system.

There is also described a method of using this increased capacity of a tank for storing natural gas or methane comprising filling the tank with an adsorbent selected from the group consisting of zeolites and metal-organic frameworks, attaching a filter system to remove presence of particles; providing means to remove stored gas from apparatus; and providing an optical sensor feedback system.

DEFINITIONS

The words "comprising," "having," "containing," and "including," and other forms thereof, are intended to be equivalent in meaning and be open ended in that an item or items following any one of these words is not meant to be an exhaustive listing of such item or items, or meant to be limited to only the listed item or items The term 'zeolites' refer to hydrated aluminosilicate minerals having a micro-porous structure and includes both natural and synthetic types.

The term 'metal-organic frameworks' refer to crystalline compounds consisting of metal ions or clusters coordinated to often rigid organic molecules to form one-, two-, or three-dimensional structures that can be porous.

The term 'natural gas' refers to gas produced from petroleum wells or by anaerobic digestion of organic material whose composition is predominantly methane, $CH_4$, but which can contain other hydrocarbons.

The term 'activated carbon' refers to a form of carbon having very fine pores: used chiefly for adsorbing gases or solutes, as in various filter systems for purification, deodorization, and decolorization.

The term 'tank' refers to a receptacle, container, or structure for holding a liquid or a gas.

| The following abbreviations are used: | |
|---|---|
| psia | pressure in pounds per square inch atmospheric |
| BET | Brunauer - Emmett - Teller (BET) theory |
| CNG | Compressed natural gas |
| MOFs | Metal-Organic Frameworks |

All publications, including patents, published patent applications, scientific or trade publications and the like, cited in this specification are hereby incorporated herein in their entirety.

BRIEF DESCRIPTION OF THE DRAWINGS

The foregoing aspects and advantages of present disclosure will become more readily apparent and understood with reference to the following detailed description, when taken in conjunction with the accompanying drawings, wherein.

The FIGURE is diagrammatic and is not drawn to scale. Corresponding parts generally bear the same reference numerals.

DETAILED DESCRIPTION

Fuel Storage System

Figure 1:
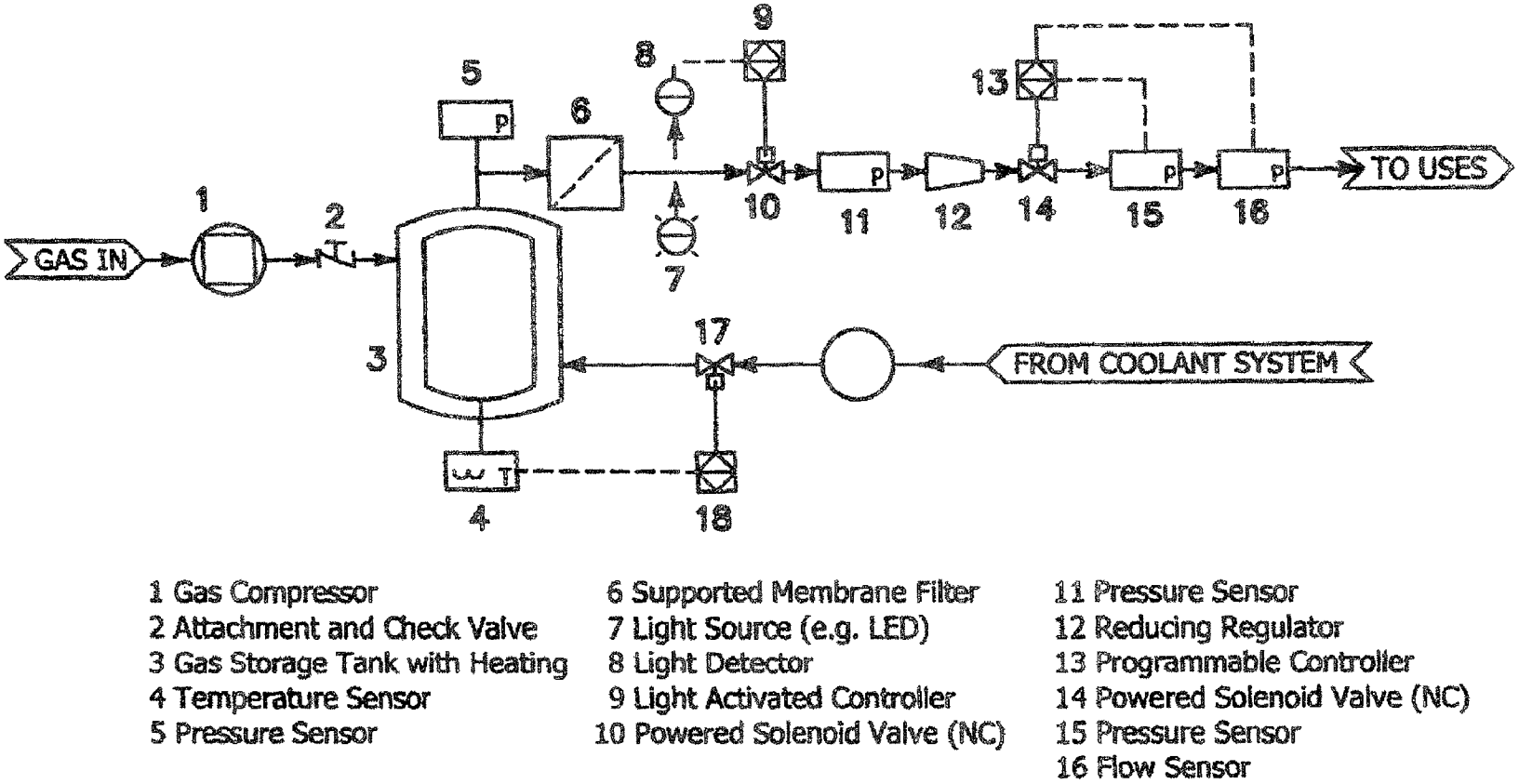
FIG. 1 illustrates a block diagram of a storage tank system.

A fuel storage system with increased storage capacity of natural gas or methane is disclosed.

Referring to FIG. 1, the block diagram illustrates the features of an exemplary fuel storage system which is designed to increase the capacity of a tank wherein natural gas or methane is stored.

The fuel storage system comprises a tank 3, a valve with a supported membrane or filter 6, a dual stage regulator 10 & 14, a powered solenoid valve 17 (normally closed (NC)), a temperature controller 18 and optionally a flow/particle sensor 16. The tank is of sufficient size to hold the desired volume of gas to be stored at various pressures ranging from atmospheric to about 4,000 psia at ambient temperature.

To increase the amount of methane stored in the tank 3, of the fuel storage system, the tank 3, is filled with activated carbon. The natural gas or methane is adsorbed to the surface area of the carbon. In another embodiment the tank 3, is filled with an adsorbent selected from the group consisting of metal-organic frameworks and zeolites.

Temperature effects on adsorption and desorption are large, and measurements are usually conducted at a constant temperature. The lower the temperature the great the adsorption capacity. Isotherms are used to predict the effect of temperature changes. The degree of heat generation can not be predicted and is based on properties such as (a) gas flow rate, (b) water vapor, and (c) presence of reactive type compounds such as ketones, aldehydes that may be present as impurities. Typically empirical relationships are needed to match the flow rate desired with the current pressure, temperature and type of specific carbon in the tank.

A valve fitting with a supported membrane 6 or a fine filter, e.g., 0.1 to 0.5 micrometer pore size is installed between the regulator 12 and the tank. Further the supported membrane filter 6 may be contained within the tank. The membrane or filter 6 is supported on both sides with mesh to allow both the high pressure filling of the tank and the higher pressure relief of the tank that allows the natural gas to pass out of the tank. The threading of the membrane/filter system is such that it allows either a single or dual stage regulator. The dual stage regulator permits one to remove natural gas from the system while ensuring that carbon is not entrained in the gas stream if there is a membrane rupture. Dual stage regulators also allow for a wide disparity between the storage pressure and the use pressure of gases in a tank. Optionally an optical particle detection system could be installed in the line outside the tank. The particle detection system 7, 8, is connected to a solenoid prior to the regulator to shut down the system in the event of a filter/membrane rupture. The tank may be wound with a coil or shell either internally or externally that are used to provide heat to the tank. The diagram in FIG. 1 illustrates a tank with a jacket for the heating and cooling processes. There are other sensors that can be used to regulate the tank parameters and flow that are known to one of ordinary skills in the art.

The Method

An inexpensive activated carbon is selected by testing the absorption characteristics of the carbon using methane or natural gas. This testing is conducted at pressures of at least about 1,500 psia. Carbons that can hold at least 30% more methane or natural gas than an equivalent volume of a tank at the same temperature and pressure are considered for further treatment to increase their ability to adsorb. Carbons that can hold at least 75 percent more methane or natural gas in a given volume than can be held in an equivalent tank volume without the presence of carbon at the same pressure and temperature are useful adsorbents to increase the mass of natural gas within a tank. A further selection of these carbons is based on their particle size which should be a size that is easily conveyed pneumatically in a stream of an inert gas; for example, nitrogen. In exemplary implementations, a particle size range of between about 150 to about 400 mesh is useful.

These carbons are very flammable and thus they are normally stored wet to reduce the danger of fire or explosion during handling and shipping. Prior to be placing in a tank the carbons are dried in an oven or air heating and drying system at 110° C. with or without a vacuum and immediately conveyed into storage tanks. Preferably the transfer of the carbon is pneumatically in an inert gas atmosphere.

Zeolites, MOFs, and carbon are all considered toxic hazardous materials for respiratory inhalation. It is critical to keep these materials contained within the system.

After the storage tank is filled under a minimal pressure (for example about 30 psia) with the carrier gas, the tank is allowed to equilibrate at atmospheric pressure. A special valve fitting is installed with a supported membrane or fine filter between the tank itself and the regulator. In exemplary implementations, the pore size of the filter in between about 0.1 and 0.3 micrometers. In one aspect, the membrane or filter is supported on both sides with mesh to allow both high pressure filling of the tank and higher pressure relief of the tank to allow the natural gas to pass out of the tank.

The filter/membrane system is threaded such that both the filling and removal of the gaseous material can be accommodated by single or dual stage regulators. In one embodiment dual stage regulators are utilized when removing natural gas from the tank to ensure that carbon is not entrained in the gas stream if there is a membrane rupture. Optionally an optical particle detection system can be installed in the line outside tank prior to engine intake of the filter/membrane system connected to a solenoid prior to the regulator to shut down the system in the event of a filter/membrane failure. The optical particle detection system is based on light scattered from any particles that may break though the barrier. The scattered light is detected at an angle from the illuminating light source (e.g. an LED) that is active when the tank is being discharged. The angle of observation is matched to maximize the signal based on classical electromagnetic theory. Typically the light scattered at 90° to 135° from the incident radiation is used.

The absorption characteristics of most carbons or other adsorbents that are useful for this process are not linear for the removal and introduction of the gaseous material for storage. This is particularly a problem in the removal of natural gas or methane at low pressure near the depletion of the gas in the tank. In some applications, for example in a vehicle, the storage tanks can be wound with a coil or shell either external or internal to the actual tank which allows fluid from the vehicle manifold or radiator system to heat the storage tank. As an example if the tanks operate in the range of 3,000 to 3,600 psia, a pressure sensor tied to a solenoid would allow heating to occur when the pressure in the tank drops to 1,000 psia or other suitable pressure. The pressure sensor can also be coupled with a temperature sensor as the removal of the natural gas is also influenced by the temperature. The temperature and pressure setting is automatically adjusted for the environment/outside temperature by using the temperature ratio as the trigger to open the solenoid. For rapid heavy loads the escape of gas alone will cool the tank and may cause difficulties in further removal of the gas. A thermal system that works on the ratio of the tank temperature to the ambient temperature alleviates this problem.

As described above and herein there are several useful sensor feedback systems that may be optionally used with the method of natural gas or methane storage system. These useful sensor feedback systems are:

A particle detector sensor 7, 8, 9 which closes the solenoid regulating the release of the gas from the tank.

A pressure sensor 15 which opens a heating system when the pressure of the gas within the tank is low.

A temperature sensor 4 to assist in controlling the pressure setting in cold weather or when there are periods of rapid gas removal from the storage tank.

The Method comprises the following basic steps:

1) Use of an activated carbon with selected adsorbent properties for natural gas or methane storage within a tank.
2) Attaching a filter/membrane system to remove entrained carbon from gas stream.
3) Providing means to remove stored gas from system.
4) Providing sensors and feedback systems that allow for safe operation of the unit, with flow characteristics over varying pressures related to the desired removal rate form the tank.

In another embodiment the Method comprises the following basic steps:

5) Use of an adsorbent selected from the group consisting of zeolites and metal-organic frameworks for natural gas or methane storage within a tank.
6) Attaching a filter/membrane system to remove entrained adsorbent from gas stream.
7) Providing means to remove stored gas from system.
8) Providing sensors and feedback systems that allow for safe operation of the unit, with flow characteristics over varying pressures related to the desired removal rate form the tank.

The system as described herein provides a method of storing natural gas or methane wherein a larger quantity of natural gas or methane can be contained within a tank of a given volume at the same pressure than the tank would hold without utilizing activated carbon.

This method can be used with all, selected or none of the sensor feedback systems Selecting Activated Carbon The absorption characteristics of activated carbon is tested as in Example A. Carbons that can hold at least 30% more methane or natural gas than the amount of methane without carbon held in the same volume of tank at the same temperature and pressure are considered for treatment to increase their adsorbent characteristics.

Improving Carbon Capacity

Activation of carbon is normally performed by pyrolysis or subsequent oxidation by an agent such as steam at temperatures up to 950° C. To reactivate carbons or to further activate carbons, a simple oxidation system based on the use of hydrogen peroxide under high pressure and temperature has been used. Normally the hydrogen peroxide solution (3-10%) is placed with the carbon particles in high pressure (up to 2,000 psia) at temperatures up to 400° C. for periods up to several hours. A typical treatment parameters is about 300° C. to 350° C. at 1700 psia for two (2) hours. The degree of the reaction is dependent on the specific carbon and can only be determined by measurement against methane or natural gas absorption. An alternative system for some carbons is to heat the carbon in a flowing stream of inert gas such as helium at 300° C. to 400° C. to remove hydrocarbons and impurities in the carbons. Different carbons from different sources respond differently to the oxidation or the inter gas method. The purpose of such treatment is to increase the adsorption sites for methane or natural gas in the structure of the carbon thus increasing the space for binding.

Under some conditions the structure of the carbon will hold multilayers of the natural gas or methane on the carbon structure. Typically the storage of more than one layer of gas is described by a relationship discovered by Brunauer, Emmett and Teller and known as the BET Adsorption Isotherm (Physical Chemistry, Gucker & Seifert, pgs. 652-661, 1966 (WW Norton & Co, NY)). The objective of treatment is to increase the number of layers of gas that can be held in the carbon structure.

Example A

Measurement of Activity

To measure the effectiveness of a specific carbon sample, a 352 ml container was used which was built to withstand pressures of at least 1,500 psia. The container is weighed (wt. I), filled with methane at the selected pressure, for example, 1,500 psia, and reweighed (wt. II). The first weight (wt. I) is subtracted from the second weight (wt. II) to obtain the weight of methane (wt. NC) the container holds at a selected pressure, for example, 1500 psia, and ambient temperature.

The container is emptied and filled with the carbon and weighed (wt. III) at room temperature and the selected pressure. Methane is again introduced into the container which contains the carbon previously weighed. The container with carbon and methane at the selected pressure and ambient temperature is reweighed (wt. IV). Subtracting the weight of the container plus carbon (wt III) from the weight of the container, carbon and methane (wt. IV) gives the weight of the methane held within the container (wt. C).

The weight of methane (wt. NC) in the container without carbon present from the measured weight of methane (wt. C) to measure the weight of methane adsorb onto the carbon; i.e., the increase in the amount of methane that can be held within the container at a set pressure and temperature.

The table given below, Table 1, details some of the results from various carbons. The last three carbons are considered acceptable for the process as described.

TABLE 1

Weight Increase with Carbon Surface Area

| Material | Surface Area For Nitrogen BET $m^2/g$ | Weight of methane Per gram carbon | Percent Increase In Natural Gas |
|---|---|---|---|
| A | 300 | 18.4 mg | 112 |
| B | 776 | 48.8 mg | 133 |
| C | 1125 | 64.0 mg | 143 |
| D | 1500 | 125.2 mg | 167 |
| E | 1600 | 249.5 mg | 146 |
| F | 1600 | 191.7 mg | 184 |
| G | 1600 | 217.5 mg | 197 |
| J | 2800 | 147.9 mg | 198 |
| AX-21 | 2000 | 248.7 mg | 260 |

The first column in the Table 1 lists the sample; the second column is the "surface area" of the carbon as measured by the adsorption of nitrogen in a specific test. The results for BET surface area are available for many adsorbents from commercial suppliers. The term BET is an acronym for the Brunauer-Emmett-Teller (BET) theory which is a standard means to calculate the surface area from the weight gain of the adsorbent exposed to nitrogen gas.

However, nitrogen is not the same as methane and, as the Table shows, the correlation between the nitrogen capacity and the methane capacity is very weak. While it is better to start with the higher surface area carbons with lower density (to keep the weight in the tanks lower) there is no certainty that one can find suitable carbons simply by selecting low density, high surface area carbons.

It appears that the last four carbons in Table 1 could be suitable for further study if they were available economically. Of these the last two are not commercially viable as they are too expensive for commercial use and the last one (AX-21) is no longer available. Activated carbons utilized to increase the storage capacity of natural gas or methane have a surface area between about 1600 to about 3000 $m^2/g$ to methane (not nitrogen). They conform to the BET description and temperature can be used to regulate the desorption isotherms. In other implementations, the activated carbon adsorbing greater than about 125 mg/gram of methane increases the storage capacity of a fuel tank.

While the above description contains many particulars, these should not be considered limitations on the scope of the disclosure, but rather a demonstration of embodiments thereof. The apparatus and methods disclosed herein include any combination of the different species or embodiments disclosed. Accordingly, it is not intended that the scope of the disclosure in any way be limited by the above description. The various elements of the claims and claims themselves may be combined in any combination, in accordance with the teachings of the present disclosure, which includes the claims.

I claim:

1. A fuel storage system with increased storage capacity for natural gas or methane storage comprising:

a storage tank filled with activated carbon;

a means of regulating temperature of the carbon in the tank;

flow regulators; and particle detection system, wherein the particle detection system comprises an optical sensor system.

2. A method for increasing the capacity of a tank for storing natural gas or methane comprising:

filling a tank with an activated carbon with selected adsorbent properties;

attaching a filter system to remove presence of particles in gas stream;

providing means to remove stored gas from the tank; and providing an optical sensor feedback system.

3. The method of claim 2 further comprising selecting activated carbon with a mesh size of between about 150 to about 400 mesh.

4. The method of claim 2 comprising activated carbon with a surface area between about 1600 to about 3000 $m^2/g$.

5. The method of claim 2 wherein the optical sensor regulates gas flow.

6. The method of claim 2 further comprising a controller regulating the temperature of the tank based on an adsorption profile of the carbon to maintain gas flow at a desired flow rate.

7. A method for increasing the capacity of a tank for storing natural gas or methane comprising:

filling a tank with an absorbent selected from the group consisting of metal-organic frameworks and zeolites;

attaching a filter system to remove presence of particles in gas stream;

providing means to remove stored gas from the tank; and providing an optical sensor feedback system.

* * * * *